US007237868B2

(12) United States Patent
Lim

(10) Patent No.: US 7,237,868 B2
(45) Date of Patent: Jul. 3, 2007

(54) CAPPING DEVICE FOR A PRINT HEAD OF AN INKJET PRINTER AND A METHOD THEREOF

(75) Inventor: Gui-taek Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 274 days.

(21) Appl. No.: 10/861,488

(22) Filed: Jun. 7, 2004

(65) Prior Publication Data

US 2005/0058265 A1 Mar. 17, 2005

(30) Foreign Application Priority Data

Sep. 15, 2003 (KR) ..... 10-2003-0063845

(51) Int. Cl.
*B41J 2/165* (2006.01)

(52) U.S. Cl. ..... 347/29; 347/30; 347/32

(58) Field of Classification Search ..... 347/29–34
See application file for complete search history.

(56) References Cited

U.S. PATENT DOCUMENTS 5,426,456 A 6/1995 Kuelzer et al. ..... 347/30
5,757,395 A * 5/1998 Chew et al. ..... 347/24
6,843,550 B2 * 1/2005 Waller et al. ..... 347/29
2002/0008728 A1 * 1/2002 Usui et al. ..... 347/29
2004/0095415 A1 * 5/2004 Alrich et al. ..... 347/29

FOREIGN PATENT DOCUMENTS

JP 07132608 5/1995
JP 08174856 7/1996
JP 08336989 12/1996
JP 09239997 9/1997
JP 10-181033 7/1998
JP P2001-347677 A * 12/2001

* cited by examiner

*Primary Examiner*—Shih-Wen Hsieh
(74) *Attorney, Agent, or Firm*—Roylance, Abrams, Berdo & Goodman, LLP

(57) ABSTRACT

A capping device and method for a print head for an inkjet printer are disclosed. The capping device has a head cap to seal the print head during the printing standby mode. The head cap has a through hole to allow a sealed portion formed between the head cap and the print head to fluidly communicate outside of the head cap. The through hole is respectively disposed at an inner wall and outer wall of the head cap. Due to the through hole, an air path is formed in the head cap to allow a sealed portion between the print head and the head cap to fluidly communicate with the outside. Even if the air in the sealed portion is heated and expanded, the pressure therein does not increase.

27 Claims, 7 Drawing Sheets

CAPPING DEVICE FOR A PRINT HEAD OF AN INKJET PRINTER AND A METHOD THEREOF

CROSS-REFERENCE TO RELATED APPLICATIONS

This application claims the benefit under 35 U.S.C. § 119(a) of Korean Patent Application No. 2003-63845, filed Sep. 15, 2003 in the Korean Intellectual Property Office, the entire contents of which are incorporated herein by reference in its entirety.

BACKGROUND OF THE INVENTION

1. Field of the Invention

The present invention generally relates to an inkjet printer. More specifically, the present invention generally relates to a capping device for a print head of an ink-jet printer, which tightly seals the print head during a driving stop state or a printing standby mode, and a method thereof.

2. Description of the Related Art

FIG. 1 is a partially-cut perspective view illustrating a conventional ink-jet printer and a conventional capping device for a print head employed therein.

As shown in FIG. 1, a conventional inkjet printer 100 includes an ink cartridge 120, a carriage 130, and a capping device 140.

The ink cartridge 120 contains ink therein, and forms an image on a printing paper by jetting the ink through a print head disposed at a side thereof during a printing operation of the inkjet printer 100.

The carriage 130 is movably disposed in a printer body 110 and supports at least one ink cartridge 120. During a printing mode of the inkjet printer 110, the carriage 130 moves back and forth in the printer body 110 so that the ink is jetted onto a section of the printing paper through the print head 125. If the inkjet printer 110 prints a unicolored image such as a black and white document, the carriage 130 supports only one ink cartridge 120. If the inkjet printer 100 prints a multicolored image, however, the carriage 130 supports plural ink cartridges 120, as shown in FIG. 1.

Typically, if the inkjet printer 110 is in a printing standby mode or a driving stop state, the carriage 130 moves out of a printing area P into a service area S at a side of the printer body 110 and waits in the service area S until the inkjet printer 100 is changed to the printing mode.

The capping device 140 for the print head 125 tightly seals the print head 125 when the carriage 130 is located in the service area S. By sealing the print head 125, the capping device 140 prevents the print head 125 from being contaminated by foreign substances and also prevents the residual ink of nozzles of the print head 125 from solidifying and closing the nozzles. The capping device 140 includes a housing 141 connected to the print body 110 and a head cap 142 that moves in a vertical direction in the housing 141. The head cap 142 substantially seals the print head 125 and is disposed on a supporting member 143. If the ink cartridge 120 moves into the service area S, the supporting member 143 is moved upward by a driving device 150, and the head cap 142 seals the print head 125 of the ink cartridge 120.

The configuration and operation of the capping device of the conventional print head 125 is disclosed in US Patent Application No. 2003/0090535, the entire contents of which are incorporated herein by reference.

In the capping device 140 of the conventional print head 125, the head cap 142 tightly seals the print head 125.

Hence, if a temperature increases while the print head 125 is capped, a pressure between the head cap 142 and the print head 125 also increases thereby damaging the print head 125. As shown in FIG. 2, there is no through hole in the head cap 142, to allow air to flow. As a result, while the print head 125 is sealed by the head cap 142, if the temperature around the print head 125 rises, the air sealed between the head cap 142 and the print head 125 expands to increase the pressure. If the pressure between the head cap 142 and the print head 125 rises, the meniscus of the ink, which flows from the ink storage of the ink cartridge 120 to the nozzle of the print head 125 and stays therein, is destroyed and the ink flows backward. The back-flow of the ink hinders effective ink firing through the nozzle.

SUMMARY OF THE INVENTION

Accordingly, an aspect of the present invention is to provide a capping device for a print head for an inkjet printer capable of preventing ink of an ink cartridge from flowing backward, by monitoring a pressure between a head cap and the print head using a predetermined threshold while the head cap seals the print head during a print standby mode, and method thereof.

To achieve the above aspect, the capping device according to one embodiment of the present invention comprises a head cap to seal the print head during a printing standby mode. The head cap has a through hole to allow a sealed portion formed between the head cap and the print head to fluidly communicate with an outside of the head cap.

The head cap comprises an inner wall and an outer wall, and a through hole comprises a first through hole formed in the inner wall and a second through hole formed in the outer wall. The first and second through holes are formed at locations opposite each other so that air does not easily flow between the sealed portion of the print head and the head cap and an outside area. If the air flows freely therebetween, the ink in a nozzle of the print head is easily solidified and blocks the nozzle. To prevent this, a plurality of ribs is disposed between the inner wall and the outer wall to obstruct the airflow between the sealed portion and the outside area.

Considering the requirement that the air path formed between the inner wall and the outer wall should not be completely blocked, the rib may be disposed between the inner wall and the outer wall in various arrangements. For example, a rib may be formed having a height smaller than that of the inner wall and the outer wall to form an air path between an upper end portion of the rib and the print head. A rib may be formed having the same height as that of the inner and outer walls and have a connecting hole through which the air flows to the rib. The air path may be formed with a first rib and a second rib disposed in alternate arrangements. That is, the first rib may extend downward from an upper end portion of the inner and outer walls to an extent it does not reach a lower end portion thereof, and the second rib may extend upward from the lower end portion of the inner and outer walls to an extent it does not reach an upper end portion thereof.

In addition, the second through hole may be formed in a bottom surface between the inner wall and the outer wall. The airflow between the sealed portion and the outside is more restrained, because the direction of the air path from the sealed portion to the outside area through the first and second through holes changes vertically as well as horizontally. Preferably, the first through hole and the second through hole are formed as far away from each other as possible.

According to another embodiment of the present invention, the capping device comprises a housing, a supporting member disposed in the housing to move vertically, a driving device to drive the supporting member, and a head cap disposed at the supporting member. The head cap has a through hole to allow a communication between an inside area and the outside area.

According to one embodiment of the present invention, the inkjet printer comprises a printer body, a carriage movably disposed in the printer body, an ink cartridge disposed at the carriage and having a print head, and a capping device having a head cap to seal the print head. The head cap has a through hole to allow the sealed portion formed between the head cap and the print head to communicate with an outside of the head cap.

BRIEF DESCRIPTION OF THE DRAWING FIGURES

The above aspects, and other features and advantages of the present invention will become more apparent after a reading of the following detailed description when taken in conjunction with the accompanying drawing s, in which.

In the drawings, it should be noted that the same or similar elements are denoted by the same reference numerals even though they are depicted in different drawings.

DETAILED DESCRIPTION OF THE EXEMPLARY EMBODIMENTS

Figure 1:
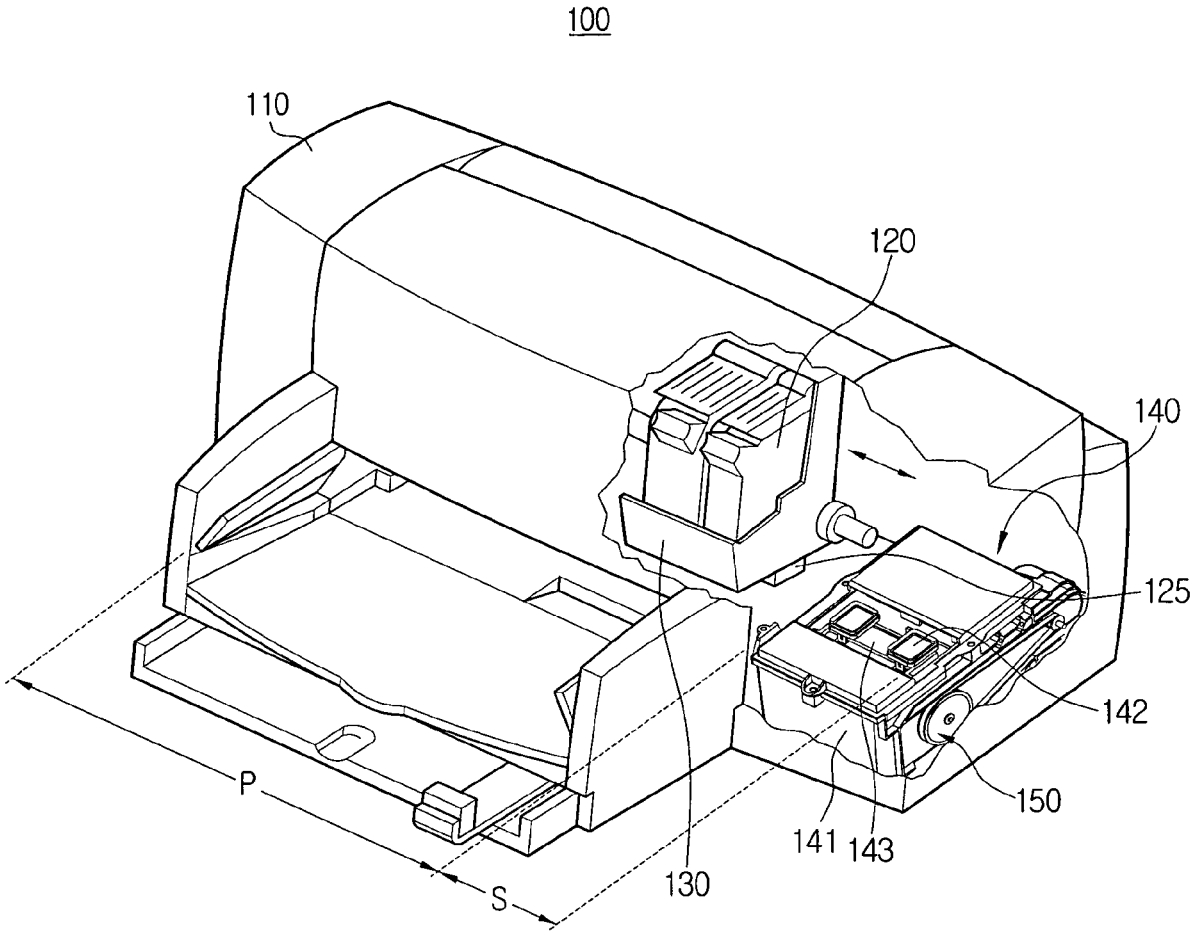
FIG. 1 (PRIOR ART)
FIG. 1 is a partially-cut perspective view illustrating a conventional inkjet printer.
Figure 2:
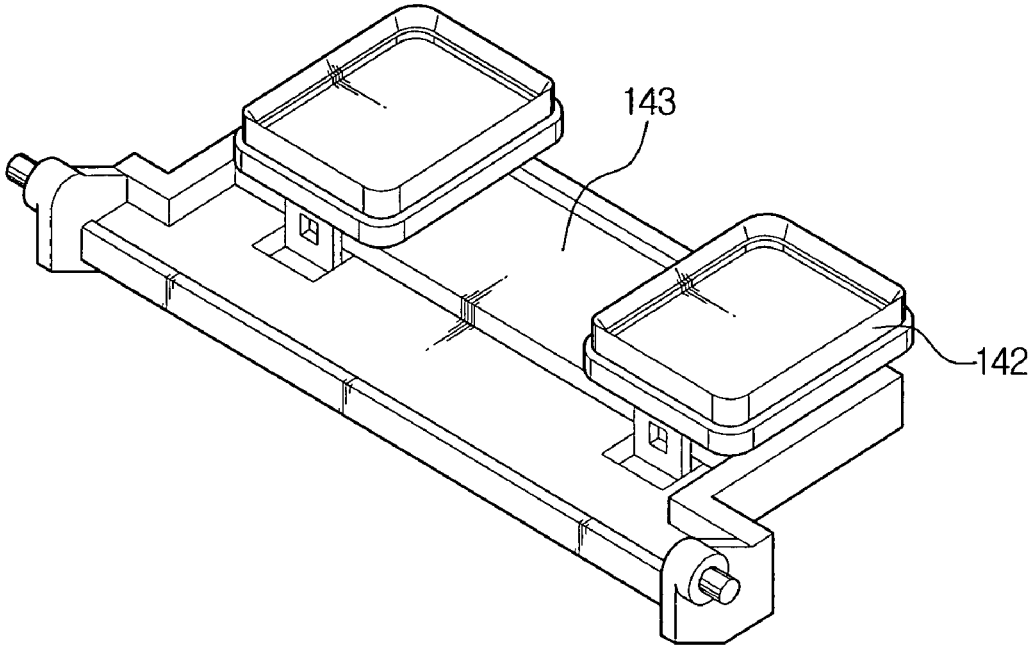
FIG. 2 (PRIOR ART)
FIG. 2 is a perspective view illustrating a capping device for the conventional inkjet printer.

A capping device for a print head for an inkjet printer according to several embodiments of the present invention and a method thereof will be illustrated with reference to the annexed drawing figures.

The capping device of the print head according to one aspect of the present invention has substantially similar construction as that of the conventional capping device, except for the construction of a head cap. Accordingly, for the description of the capping device of the present invention, elements having the same function and structure as the elements of the conventional capping device will be given the same reference numerals and description thereof will be omitted for conciseness.

Figure 3:
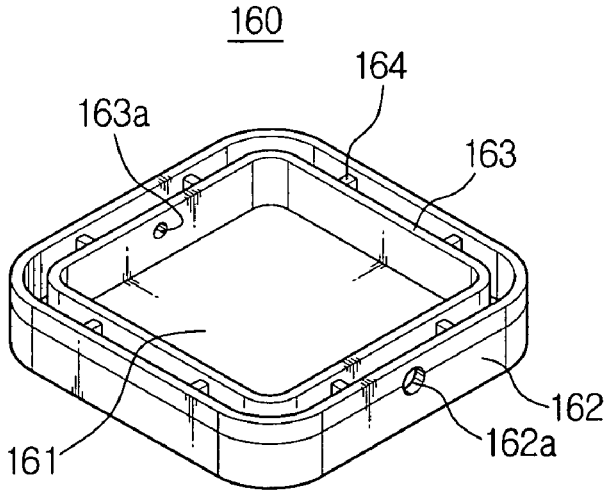
FIG. 3 is a perspective view illustrating a head cap of a capping device according to an embodiment of the present invention.
Figure 4A:
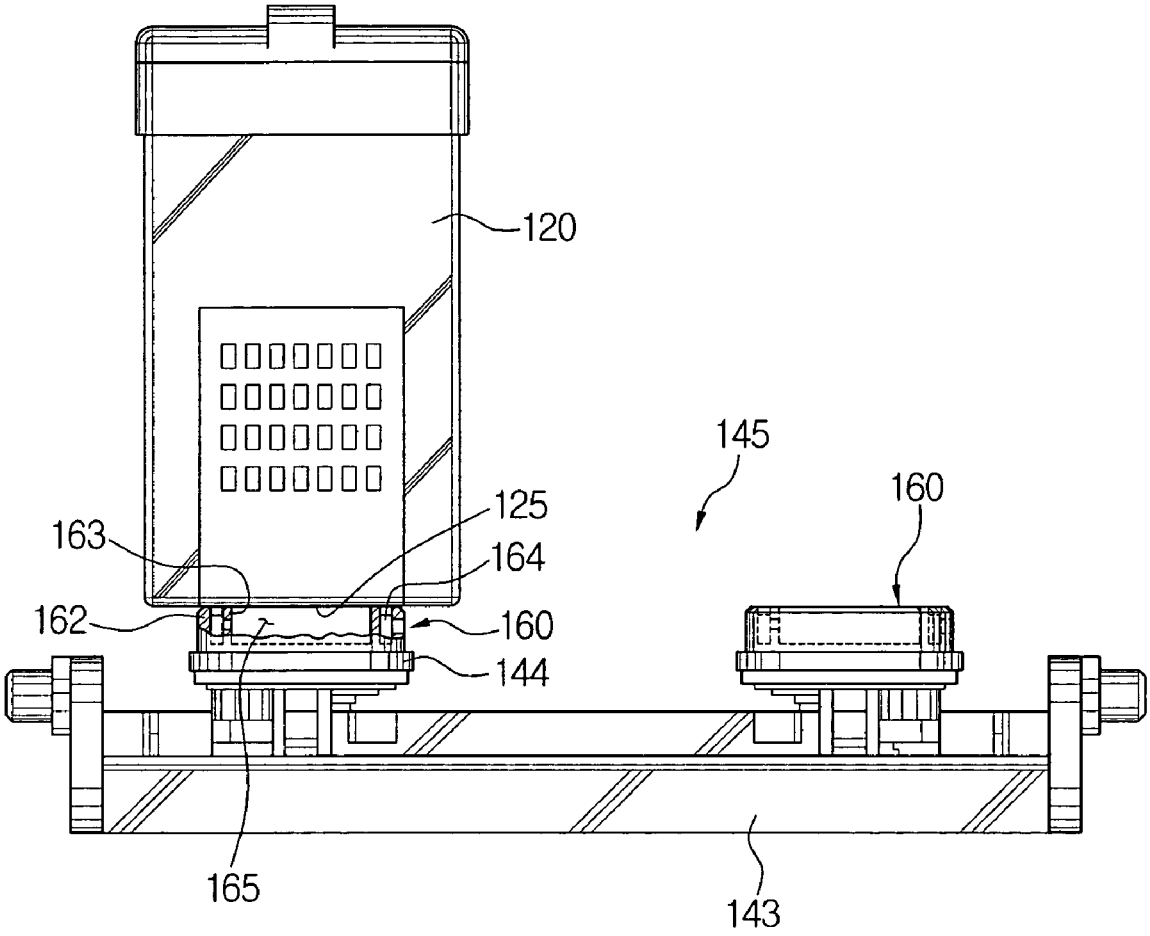
FIGS. 4A through 4D are front views illustrating a main construction of the capping device according to embodiments of the present invention.

Referring to FIGS. 1, 3, and 4A, a capping device 145 of a print head 125 according to one embodiment of the present invention comprises a housing 141, a supporting member 143, and a head cap 160.

A general housing 141, as that of the conventional capping device, may be used. As shown in FIG. 1, the housing 141 is disposed in a printer body 110 and the supporting member 143 is disposed in the housing 141 to move in a vertical direction. A driving device 150 is disposed at the housing 141 to move the supporting member 143. The driving device 150 may comprise a link device as disclosed in the above-mentioned US Patent Application No. 2003/0090535 filed by the present Applicant. However, one should appreciate that the present invention is not limited to this embodiment. Therefore, to move the supporting member 143 in a vertical direction, various driving devices may be applied.

The supporting member 143, as shown in FIGS. 4A through 4D, supports the head cap 160 and is connected to the driving device 150 of FIG. 1. The supporting member 143 is not limited to that shown FIGS. 4A through 4B and may be shaped and configured in different arrangements according to the driving device 150.

The head cap 160 substantially seals the print head 125 and is disposed on a head cap holder 144 of the supporting member 143, as shown in FIG. 4A. The number of head caps 160 corresponds to the number of print heads 125 of the inkjet printer. According to an exemplary embodiment of the present invention, the inkjet printer has two ink cartridges 120, two print heads 125, and two head caps 160. The head caps 160 comprise a rubber material in the general head cap, to enhance the sealing efficiency with respect to the print head 125. However, it should be appreciated by those skilled in the art that any other suitable materials can be used.

As shown in FIG. 3, the head cap 160 comprises a bottom surface 161, an outer wall 162 extending in an upward direction from a circumference of the bottom surface 161, and an inner wall 163 formed inside the outer wall 162 with a predetermined gap therebetween. The height of the outer wall 162 and the inner wall 163 is preferably the same. During the printing standby mode, as the head cap 160 moves upward to the print head 125, the bottom surface 161 and the inner wall 163 form a sealed space 165 with the print head 125, and an air path is formed between the inner wall 163 and the outer wall 162, as shown in FIG. 4A.

As shown in FIG. 3, first and second through holes 163*a* and 162*a* are respectively formed in the inner and the outer walls 163 and 162. Preferably, the first through hole 163*a* and the second through hole 162*a* are formed on opposing sides and formed as far apart from each other as possible. By extending the length of the air path from the first through hole 163*a* to the second through hole 162*a*, the air does not flow easily between the sealed space 165 and an outside area. A plurality of ribs 164 is formed between the outer wall 162 and the inner wall 163. The ribs 164 obstruct the air flow in the air path between outer wall 162 and the inner wall 163. The ribs 164 should not completely block the air flow between the sealed space 165 and the outside.

In the head cap 160 shown in FIG. 4A, the height of the ribs 164 is smaller than that of the inner wall 163 and the outer wall 162. The air path is formed between an upper end portion of the ribs 164 and the print head 125, so that the ribs 164 obstruct the airflow.

Figure 4B:
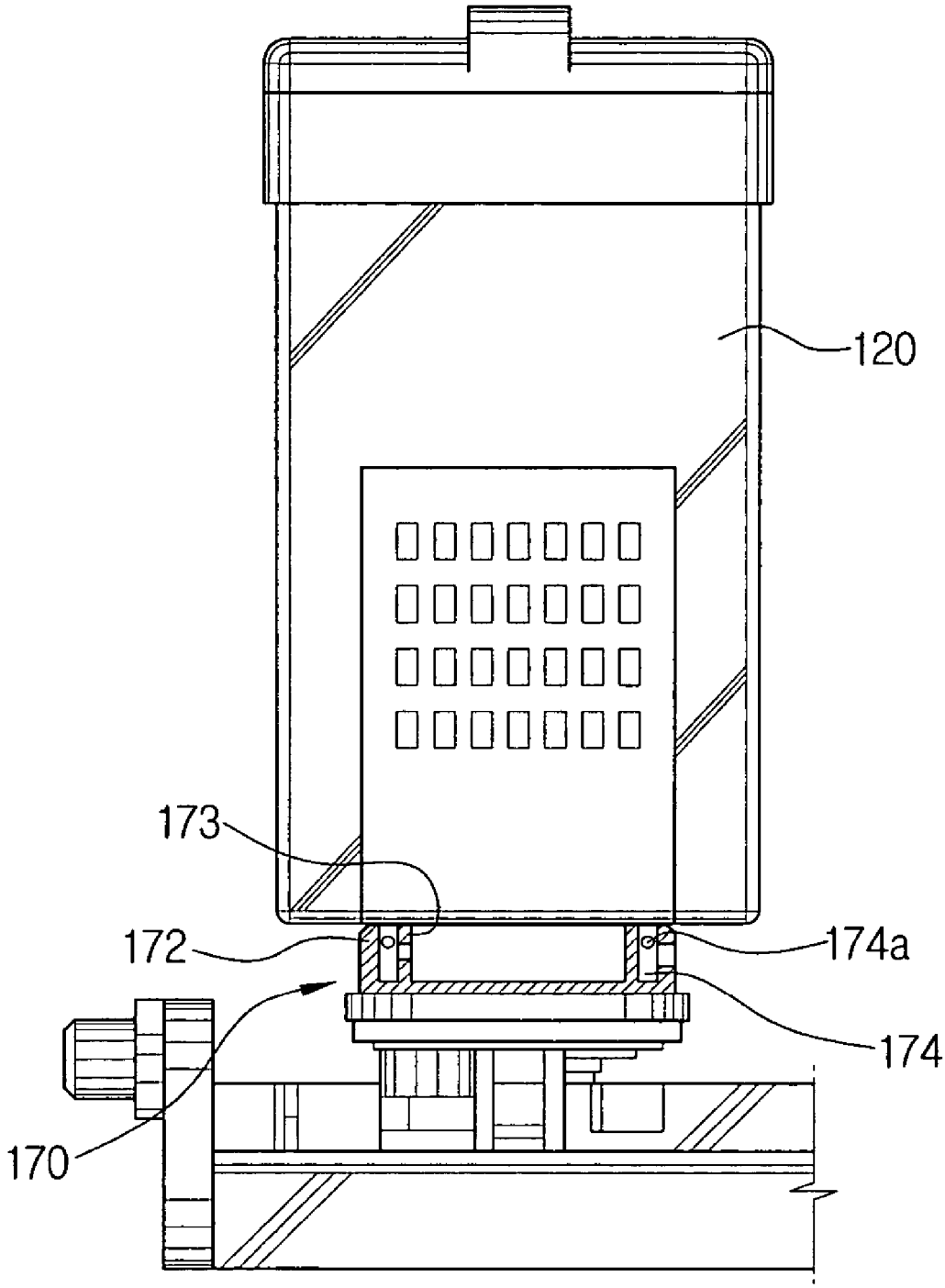

In the head cap 170 shown in FIG. 4B, the height of the ribs 174 is the same as that of the inner wall 173 and the outer wall 172. Accordingly, to form an air path, a connecting hole 174*a* is formed in the respective ribs 174.

Figure 4C:
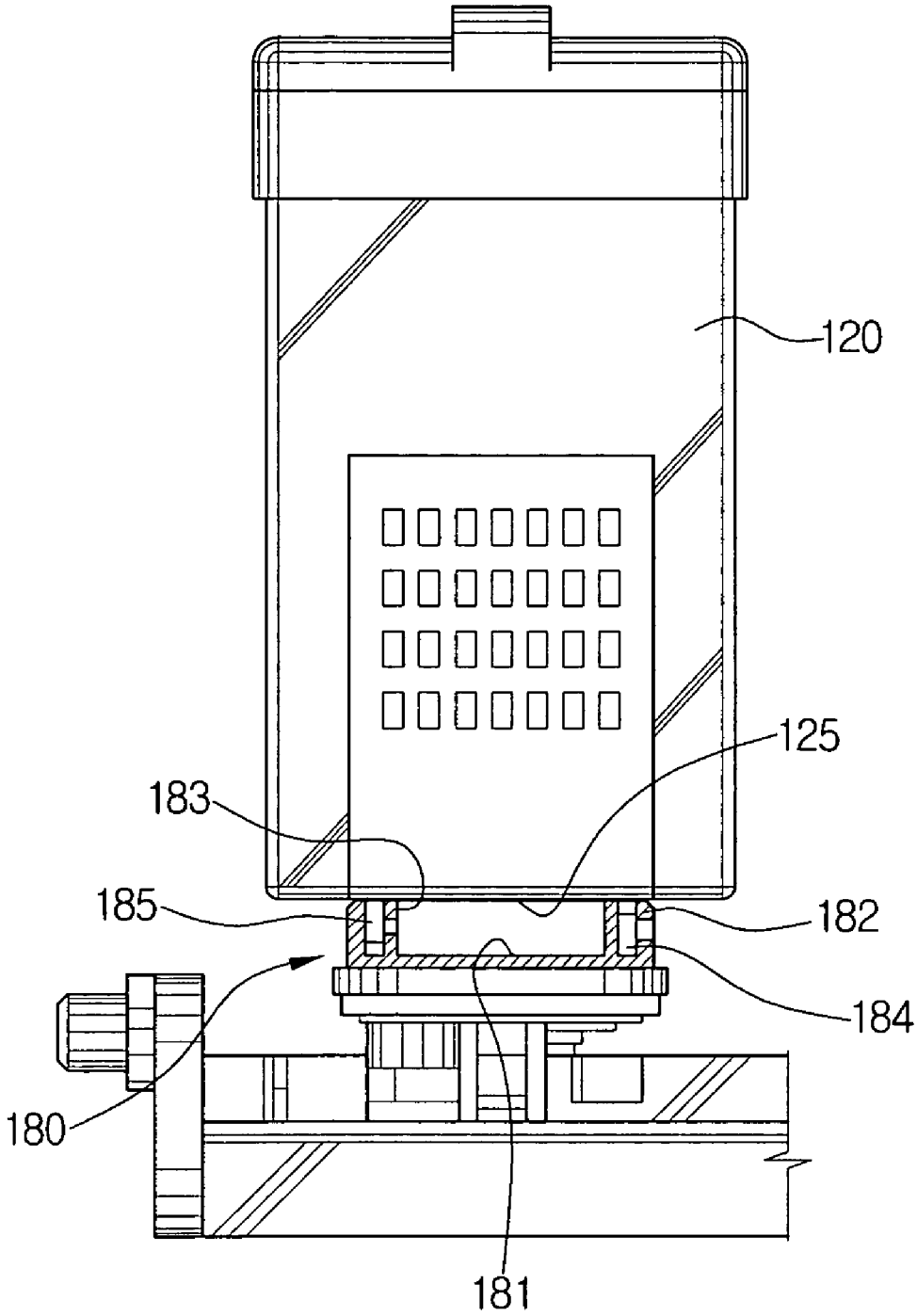

In head cap 180 shown in FIG. 4C, a first rib 184 and a second rib 185 are disposed on different planes. For example, the first rib 184 may extend from a lower portion of the inner wall 183 and the outer wall 182 upwardly from the bottom surface 181 to a height that does not reach an upper portion of the inner wall 183 and the outer wall 182. The second rib 185 may extended downward from the upper portion of the inner wall 183 and the outer wall 182 to a level that does not reach the bottom surface 181. Accordingly, upon sealing the print head 125, the air path is formed through a space between the first rib 184 and the print head 125 and a space between the second rib 185 and the bottom surface 181.

Figure 4D:
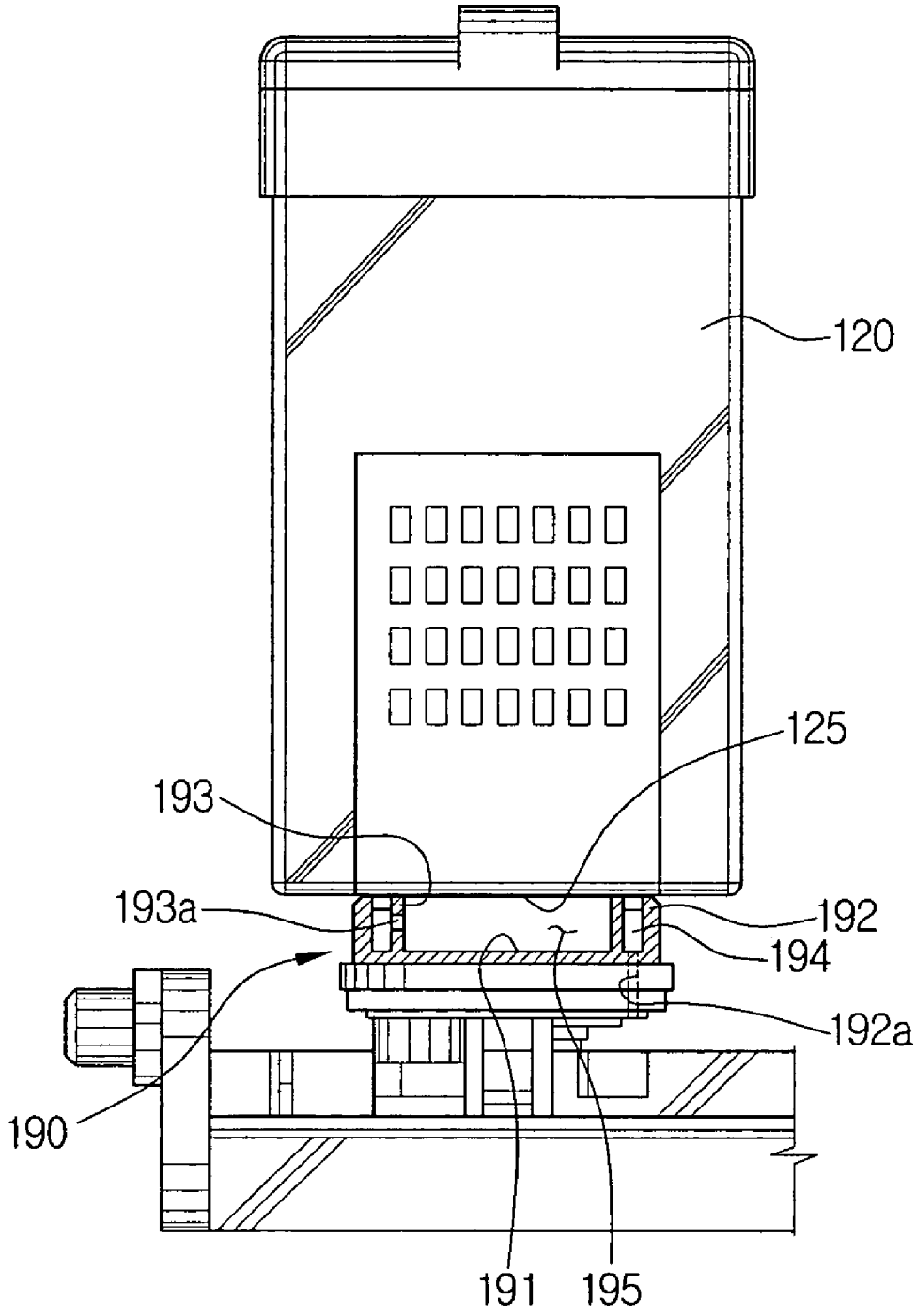

FIG. 4D shows another head cap 190 having a second through hole 192*a* formed at different locations. A first through hole 193*a* is formed at an inner wall 193, and the second through hole 192*a* is formed in a bottom surface 191 between the inner wall 193 and the outer wall 192. Due to the second through hole 192*a* formed in the bottom surface 191, the direction of the air path, which is formed from the sealed portion 195 to the outside area through the first through hole 193*a* and the second through hole 192*a*, is changed not only horizontally but also vertically. Hence, the air flow between the sealed portion 195 and the outside is more restricted. Preferably, the first through hole 193*a* and the second through hole 192*a* are located as far away from each other as possible.

The operation of the capping device 145 of the print head 125 for the inkjet printer according to an embodiment of the present invention will now be discussed with reference to the drawings below.

Figure 5:
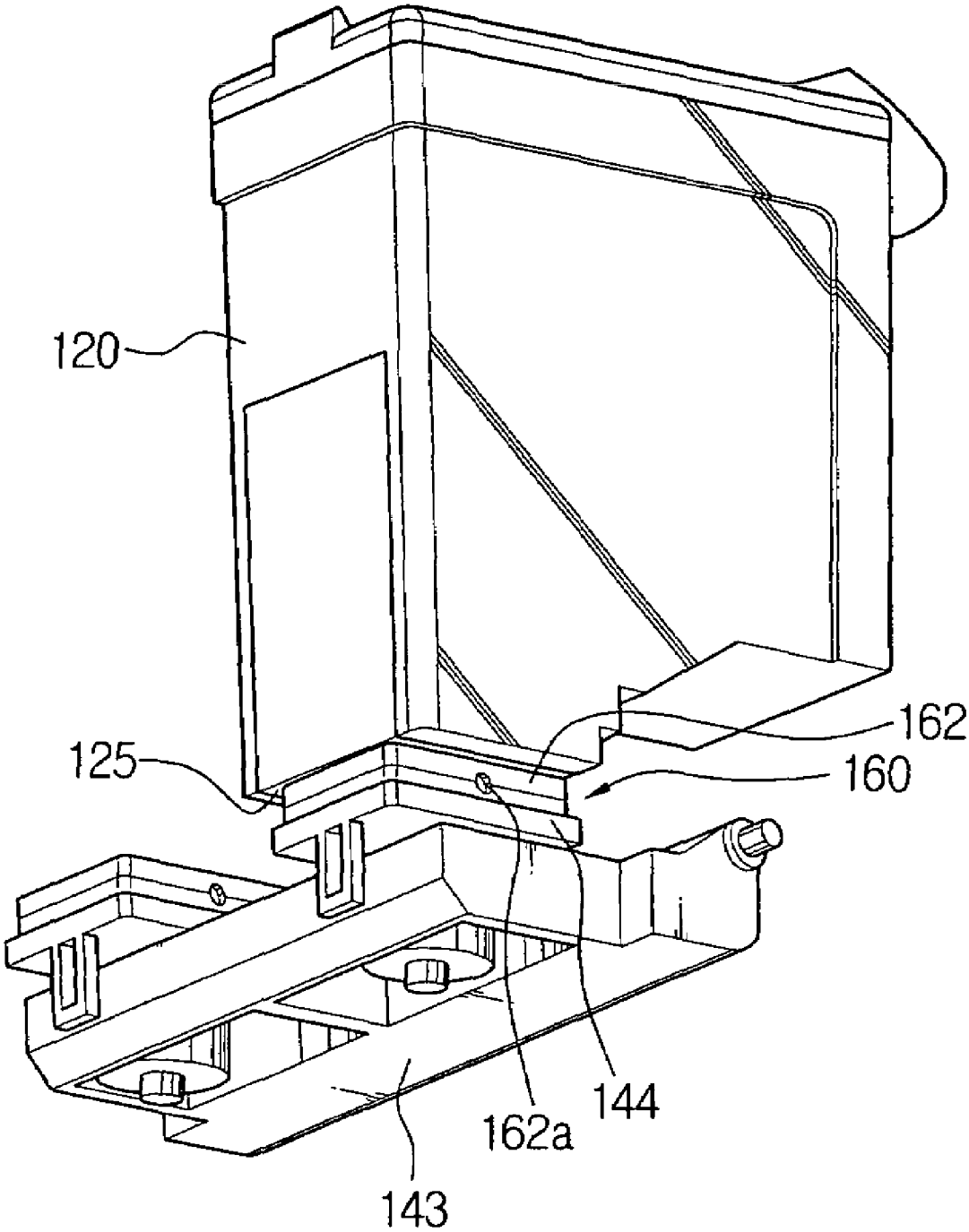
FIG. 5 is a bottom perspective view illustrating an operation of the capping device of a print head for the inkjet printer according to an embodiment of the present invention.

As shown in FIG. 1, when the printing operation is complete and the carriage 130 moves the ink cartridge 120 into the service area S, the driving device 150 operates the supporting member 143. With the operation of the supporting member 143, as shown in FIG. 5, the head cap 160 ascends toward the ink cartridge 120, and the upper end portion of the inner wall 163 (FIG. 4A) and the outer wall 162 are contacted with the print head 120. Referring to FIG. 4A, the print head 125 is sealed by the head cap 160 and the sealed portion 165 fluidly communicates with the outside through the first through hole 163*a* of FIG. 3, the air path formed between the inner wall 163 and the outer wall 162, and a second through hole 162*a* of FIG. 3. Accordingly, if the temperature around the print head 125 rises and air expands in the sealed portion 165, the expanded air is discharged to the outside area through the first through hole 163*a* and the second through hole 162*a*. As a result, even if the temperature rises, the pressure in the sealed portion 165 does not rise, but is maintained at a certain level.

The inkjet printer according to an embodiment of the present invention comprises the printer body 110, the carriage 130, the ink cartridge 120, and the capping device 145, as shown in FIGS. 1 and 4A. The inkjet printer has substantially a similar construction with the conventional inkjet printer, except for the capping device 145. The capping device 145 is illustrated in detail above, and the other constructions and operations that are well known are not illustrated.

As aforementioned, according to embodiments of the present invention, the sealed space 165 of FIG. 4A between the head cap 160 and the print head 125 fluidly communicates with the outside through the through holes 162*a*, 163*a* of FIG. 3 formed in the head cap 160. Hence, even though the temperature around the print head 125 rises and the air expands in the sealed space 165, the pressure in the sealed space 165 does not rise. As a result, the meniscus of the ink, which is located at the nozzle of the print head 125, is not destroyed by the pressure increase of the sealed space 165 as in the conventional inkjet printer so that the ink is prevented from flowing backward.

Although embodiments of the present invention have been shown and described, it should be appreciated to those skilled in the art that changes may be made in this embodiment without departing from the principles and spirit of the invention, the scope of which is defined in the claims and their equivalents.

What is claimed is:

1. A capping device for a printer head for an inkjet printer comprising:

a head cap having an inner wall and an outer wall which are spaced apart from each other to form an air path therebetween, the head cap having a through hole for allowing a sealed portion formed between the head cap and the print head to be in fluid communication with the outside of the capping device.

2. The capping device of claim 1, wherein the through hole comprises a first through hole formed in the inner wall and a second through hole formed in the outer wall, wherein the first and second through holes are disposed on opposing sides of the inner and outer walls, respectively.

3. The capping device of claim 1, wherein the head cap comprises a rubber material.

4. A capping device for a printer head for an inkjet printer comprising:

a head cap having an inner wall and an outer wall which are spaced apart from another by a predetermined spacing;

a first through hole formed in the inner wall and a second through hole formed in the outer wall for allowing a sealed portion formed between the head cap and the print head to fluidly communicate outside of the head cap; and at least one rib disposed between the inner wall and the outer wall to obstruct an air flow between the first through hole and the second through hole.

5. The capping device of claim 4, wherein a height of the rib is less than the height of the inner wall and the outer wall.

6. The capping device of claim 4, wherein the height of the rib is the same as that of the inner wall and the outer wall, and the rib has a connecting hole.

7. The capping device of claim 4, wherein the rib comprises a first rib extending downward from an upper end portion of the inner and outer walls to a level that does not reach a bottom surface of the walls, and a second rib extending upward from the lower end portion of the inner and outer walls to an extent it does not reach an upper edge of the walls.

8. A capping device for a print head for an inkjet printer comprising:

a head cap having an inner wall and an outer wall spaced apart from one another to form an air path and a first through hole formed in a first side of the inner wall, the first through hole connecting a sealed portion formed between the print head to the air path, and a second through hole formed in a bottom surface of the air path between the inner wall and the outer wall, the second through hole connecting the air path with the outside of the head cap.

9. The capping device of claim 8, wherein the second through hole is formed at the opposite side of the head cap from the first through hole.

10. A capping device of a print head for an inkjet printer comprising:

a housing;

a supporting member disposed in the housing to move in a vertical direction;

a driving device to drive the supporting member; and a head cap disposed at the supporting member, the head cap comprising:

an inner wall to form a sealed portion with respect to a print head;

an outer wall spaced away from the inner wall and forming an air path between the inner wall and the outer wall;

a first through hole in the inner wall to connect the sealed portion to the air path;

a second through hole in the outer wall to connect the air path with the outside of the capping device.

11. The capping device of claim 10, wherein the first and second through holes are formed at locations opposite each other.

12. A capping device of a print head for an inkjet printer comprising:

a housing;

a supporting member disposed in the housing to move in a vertical direction;

a driving device to drive the supporting member; and a head cap disposed at the supporting member, the head cap comprising an inner wall and an outer wall and having a first through hole formed in the inner wall and a second through hole formed in the outer wall to allow an inside thereof to fluidly communicate outside the capping device; and at least one rib disposed between the inner wall and the outer wall.

13. A capping device of a print head for an inkjet printer comprising:

a housing;

a supporting member disposed in the housing to move in a vertical direction;

a driving device to drive the supporting member; and a head cap disposed at the supporting member, the head cap comprising:

an inner wall, an outer wall, the inner and outer walls defining an air path having a bottom surface therebetween, a first through hole formed in the inner wall; and a second through hole formed in the bottom surface between the inner wall and the outer wall, the first and second through holes allowing an inside of the head cap to fluidly communicate outside the capping device.

14. The capping device of claim 13, wherein the second through hole is formed on an opposite side of the head cap as the first through hole.

15. An inkjet printer comprising;

a printer body;

a carriage movably disposed in the printer body;

an ink cartridge disposed at the carriage and having a print head; and a capping device having a head cap to seal the print head, the head cap comprising an inner wall and an outer wall defining an air path therebetween to allow a sealed portion formed between the head cap and the print head to be in fluid communication with the outside of the capping device.

16. The inkjet printer of claim 15, further comprising a first through hole formed in the inner wall to connect the sealed portion with the air path and a second through hole formed in the outer wall to connect the air path with the outside of the capping device.

17. The inkjet printer of claim 15, wherein the capping device comprises:

a housing disposed in the print body;

a supporting member disposed to move vertically in the housing and to support the head cap; and a driving device for driving the supporting member.

18. An inkjet printer comprising:

a printer body;

a carriage movably disposed in the printer body;

an ink cartridge disposed at the carriage and having a print head; and a capping device having a head cap to seal the print head, the head cap comprising an inner wall and an outer wall, a first through hole formed in the inner wall and a second through hole formed in the outer wall to allow a sealed portion formed between the head cap and the print head to fluidly communicate outside of the head cap; and at least one rib disposed between the inner wall and the outer wall.

19. A method for sealing a print head when a printer is in a standby mode comprising:

providing a head cap having an inner wall and an outer wall spaced apart from each other to form an air path therebetween, a first through hole formed in the inner wall for allowing a sealed portion formed between the head cap and the print head to be in fluid communication with the air path, and a second through hole formed in the outer wall for allowing the air path to be in fluid communication with an outside of the head cap.

20. The method of claim 19, further comprising:

manufacturing the head cap from rubber.

21. A method for sealing a print head when a printer is in a standby mode comprising:

providing a head cap having an inner wall and an outer wall, the inner wall and the outer wall having a predetermined spacing between them;

providing a through hole comprising a first through hole formed in the inner wall and a second through hole formed in the outer wall for allowing a sealed portion formed between the head cap and the print head to fluidly communicate outside of the head cap;

providing at least one rib disposed between the inner wall and the outer wall to obstruct an air flow between the first through hole and the second through hole.

22. The method of claim 21, wherein a height of the rib is less than the height of the inner wall and the outer wall.

23. The method of claim 21, wherein the height of the rib is the same as that of the inner wall and the outer wall.

24. The method of claim 23, wherein the rib has a connecting hole.

25. The method of claim 21, wherein the rib comprises a first rib extending downward from an upper end portion of the inner and outer walls to a level that does not reach a bottom surface of the walls, and a second rib extending upward from the lower end portion of the inner and outer walls to an extent it does not reach an upper edge of the walls.

26. A method for sealing a print head when a printer is in a standby mode comprising:

providing a head cap having an inner wall and an outer wall and through hole for allowing a sealed portion formed between the head cap and the print head to fluidly communicate outside of the head cap, the through hole comprising a first through hole formed in a first side of the inner wall and a second through hole formed in a bottom surface between the inner wall and the outer wall.

27. The method of claim 26, wherein the second through hole is formed at the bottom surface which is defined between a second side of the inner wall, which is opposite to the first side of the inner wall, and the outer wall.

* * * * *